US009016212B2

(12) United States Patent
Valiulis

(10) Patent No.: US 9,016,212 B2
(45) Date of Patent: Apr. 28, 2015

(54) PALLET SKIRT WRAP

(75) Inventor: Thomas E. Valiulis, Rockford, IL (US)

(73) Assignee: Southern Imperial, Inc., Rockford, IL (US)

( * ) Notice: Subject to any disclaimer, the term of this patent is extended or adjusted under 35 U.S.C. 154(b) by 295 days.

(21) Appl. No.: 13/453,471

(22) Filed: Apr. 23, 2012

(65) Prior Publication Data

US 2013/0277267 A1 Oct. 24, 2013

(51) Int. Cl.

| | |
|---|---|
| ***B65D 19/00*** | (2006.01) |
| ***B65D 19/38*** | (2006.01) |
| ***B65D 19/12*** | (2006.01) |
| ***A47B 17/00*** | (2006.01) |
| ***B65D 65/00*** | (2006.01) |
| ***B65D 75/00*** | (2006.01) |
| ***G09F 23/06*** | (2006.01) |

(52) U.S. Cl.

CPC ..... *B65D 19/0095* (2013.01); *G09F 23/06* (2013.01); *B65D 2519/00273* (2013.01); *B65D 2519/00293* (2013.01); *B65D 2519/00323* (2013.01); *B65D 2519/00333* (2013.01); *B65D 2519/00373* (2013.01); *B65D 2519/00437* (2013.01); *B65D 2519/00442* (2013.01); *B65D 2519/00447* (2013.01)

(58) Field of Classification Search

USPC ..... 229/87.01; 108/51.11, 54.1, 56.3, 27

See application file for complete search history.

(56) References Cited

U.S. PATENT DOCUMENTS

| | | | | |
|---|---|---|---|---|
| 3,073,439 | A * | 1/1963 | Symmonds, Jr. | 206/453 |
| 3,209,905 | A * | 10/1965 | Kean, Sr. | 206/597 |
| 3,904,066 | A * | 9/1975 | Wilson | 220/7 |
| 4,938,357 | A * | 7/1990 | Schmidt | 206/453 |
| 5,050,846 | A * | 9/1991 | Goodman et al. | 256/1 |
| 5,383,408 | A * | 1/1995 | Searcy | 108/57.16 |
| 5,518,348 | A * | 5/1996 | Tucker | 410/99 |
| 5,909,808 | A * | 6/1999 | Bartholomew | 206/451 |
| 5,913,501 | A * | 6/1999 | Heuss et al. | 248/346.07 |
| 6,050,419 | A | 4/2000 | Flanagan et al. | |
| 6,185,898 | B1 | 2/2001 | Pratt | |
| 6,192,807 | B1 * | 2/2001 | Mason | 108/51.11 |
| 6,260,487 | B1 * | 7/2001 | Giorgio | 108/51.11 |
| 6,375,164 | B1 * | 4/2002 | Siegler et al. | 256/1 |
| 6,408,768 | B1 * | 6/2002 | Giampavolo et al. | 108/27 |
| 6,682,055 | B1 * | 1/2004 | Tomlinson et al. | 256/1 |
| D520,709 | S * | 5/2006 | Giampavolo et al. | D34/38 |
| 2004/0129185 | A1 * | 7/2004 | Giampavolo et al. | 108/51.11 |
| 2009/0261008 | A1 | 10/2009 | Dillon et al. | |

* cited by examiner

*Primary Examiner* — Jes F Pascua
*Assistant Examiner* — Derek Battisti
(74) *Attorney, Agent, or Firm* — Reinhart Boerner Van Deuren P.C.

(57) ABSTRACT

A wrap for a retail display, e.g., a pallet, is provided. The wrap includes corner units and a strap. The strap is releasably interfaced with corner units, with the corner units locating the strap relative to a retail display. The strap may include indicia such as printed indicia, such as, for example, advertisements.

6 Claims, 15 Drawing Sheets

PALLET SKIRT WRAP

FIELD OF THE INVENTION

This invention generally relates to display of products, and more particularly to a wrap for use with a display of products.

BACKGROUND OF THE INVENTION

Pallets or skids are often used in the retail merchandise industry to display products. In many retail stores prepared skids may be used to present products in various locations including in main aisles throughout the stores. Items displayed on the pallets or skids may vary from seasonal products to fast moving retail products to produce, beverages, or many other suitable items. Designed displays of retail items may be supported on pallets or skids. Pallets or skids may be used to transport the displays and goods.

BRIEF SUMMARY OF THE INVENTION

In one aspect, an embodiment of a display wrap is provided. The display wrap includes first and second corner units each configured to couple with respective corners of a retail display. The pallet has a perimeter surface. The display wrap also includes a strap. The strap is configured to extend from the first corner unit to the second corner unit generally covering at least a portion of the perimeter surface. The first and second corner units are configured to interface with the strap to position the strap relative to the retail display when the first and second corner units are coupled with corners of the retail display.

In another aspect, an embodiment of a retail display wrap is provided. The retail display wrap includes first, second, third, and fourth corner units. The retail display wrap also includes a strap. The strap is configured to extend around the perimeter of a retail display from the first corner unit, to the second corner unit, to the third corner unit, to the fourth corner unit, to the first corner unit. The corner units are configured to interface with the strap to position the strap relative to the retail display.

In another aspect, an embodiment of a retail display wrap is provided. The retail display wrap includes first, second, third, and fourth corner units. The retail display wrap also includes first, second, third, and fourth straps. The first strap is configured to be coupled with each of the first and second corner units and to extend along a first side of a perimeter of a retail display. The second strap is configured to be coupled with each of the second and third corner units and to extend along a second side of the perimeter of the retail display. The third strap is configured to be coupled with each of the third and fourth corner units and to extend along a third side of the perimeter of the retail display. The fourth strap is configured to be coupled with each of the fourth and first corner units and to extend along a fourth side of the perimeter of the retail display.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of embodiments of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning now to the drawings, embodiments of pallet wraps according to the present invention that provide for an attractive covering for a pallet or skid, referred to generally as a pallet in the disclosure below, are described. Although illustrated and described in the context of a pallet, those skilled in the art will recognize the applicability of the wraps herein to other retail displays. As such, the term "pallet" should be taken by way of example and not limitation.

Figure 1:
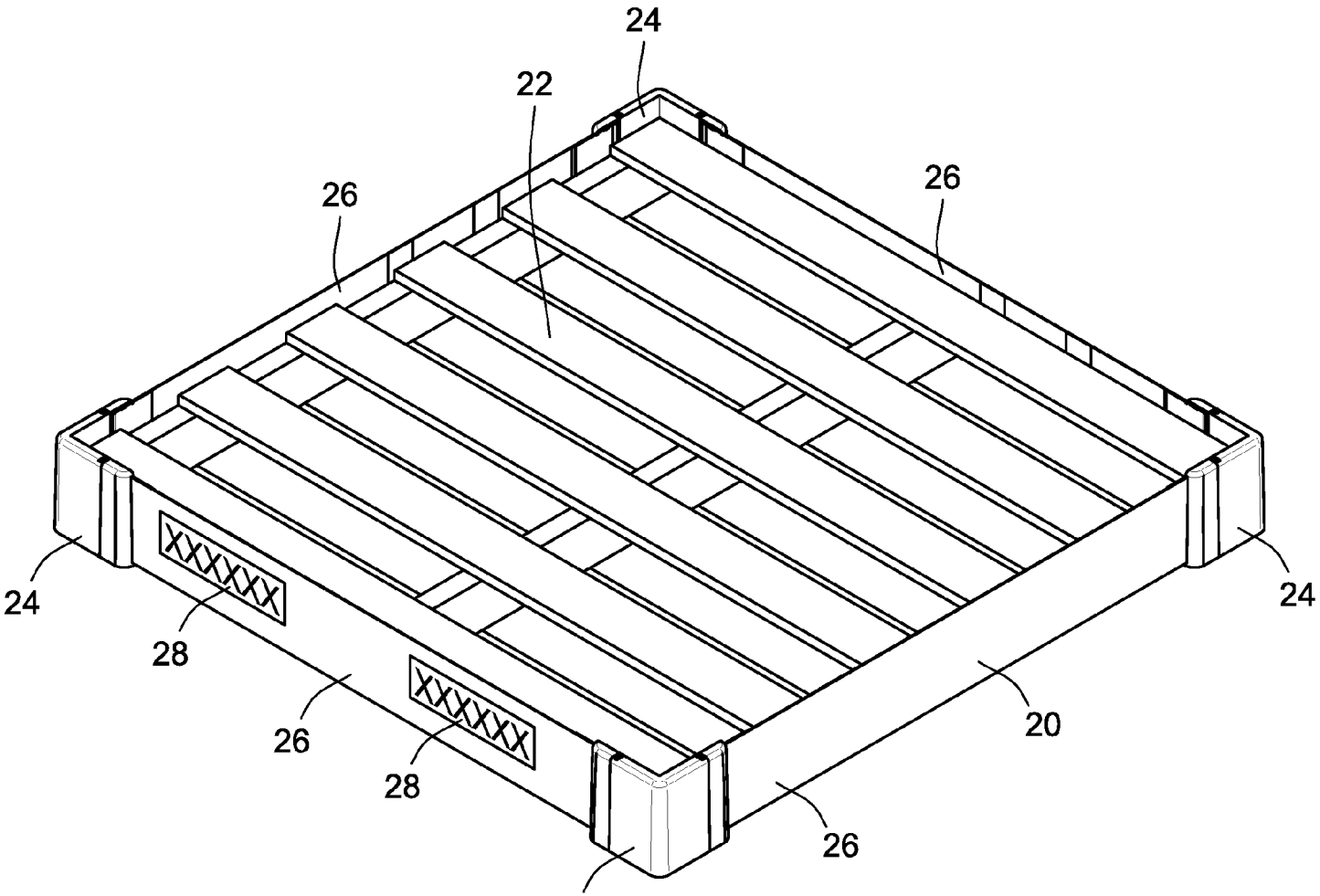
FIG. 1 is a perspective view of an embodiment of a pallet wrap engaged with a pallet.

With reference to FIG. 1, an embodiment of a pallet wrap 20 is illustrated wrapping a pallet 22. The pallet wrap 20 includes four corner units 24 and four straps 26. The corner units 24 and the straps 26 generally surround the perimeter of the pallet 22, hiding the outer perimeter of the pallet 22 from view. The straps 26 may each include indicia 28, such as advertisements, information regarding the product on the pallet, pricing, or any other information, printed thereon. Additionally, the indicia 28 may instead be attached to the straps 26 by any suitable mechanism. One or more of the straps 26 may include indicia 28. Additionally, different indicia 28 may be included on different straps.

Figure 2:
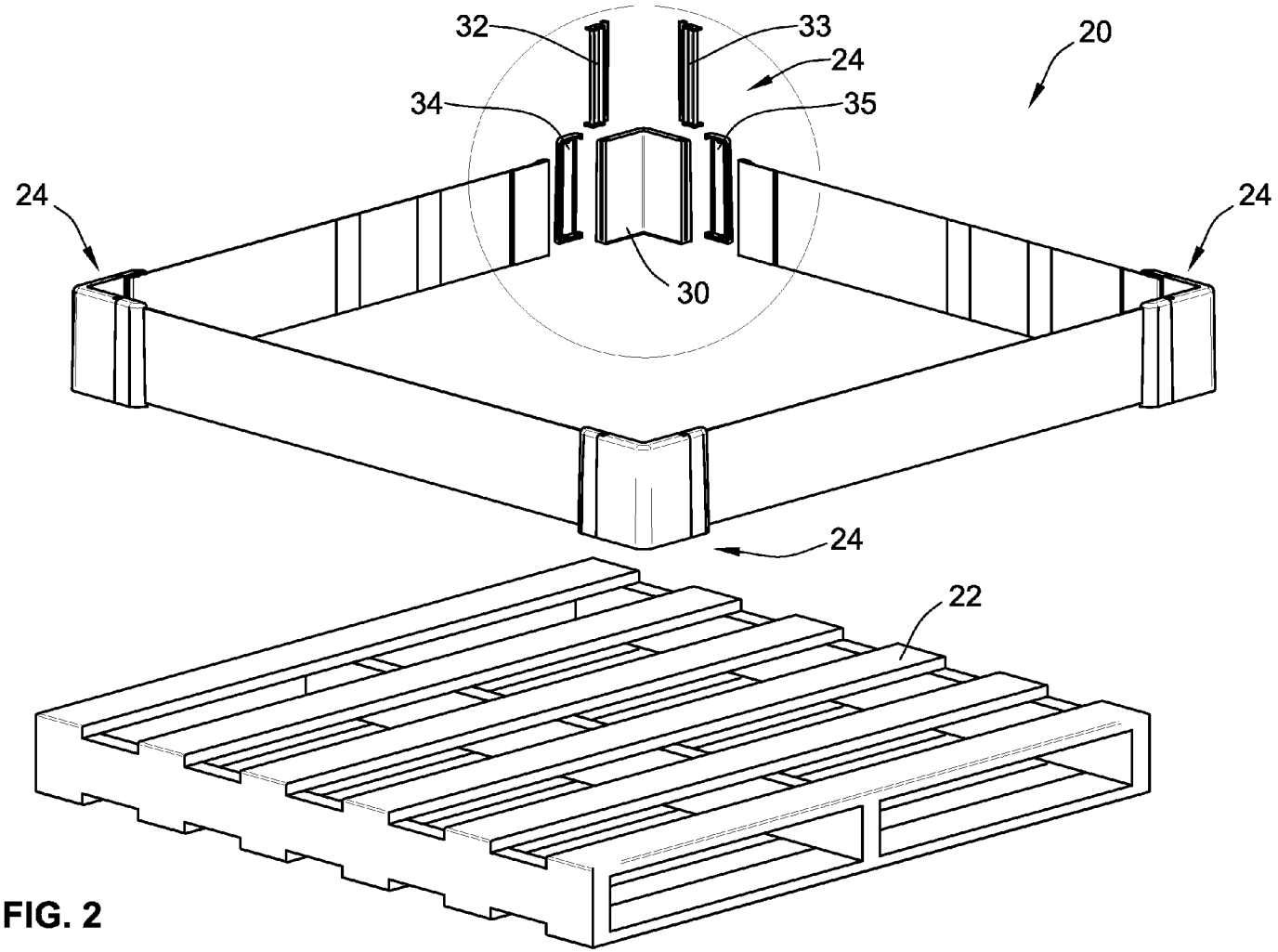
FIG. 2 is a perspective view of the pallet and pallet wrap of FIG. 1 with the pallet wrap exploded from the pallet and one of the corner units exploded.

With reference to FIG. 2, the pallet wrap 20 is illustrated exploded away from the pallet 22. In the illustrated embodiment the pallet wrap 20 includes four corner units 24 that are substantially identical. One of the corner units 24 is illustrated in an exploded configuration. The corner unit 24 includes a central portion 30 to which a pair of strap connectors 32 and 33 are coupled. The corner unit 24 also includes a pair of covers 34 and 35, each configured to interface with one of the strap connectors 32 and 33.

Pallets may be of various, non-standard sizes. In one embodiment, the straps 26 are formed from elastic material (e.g., elastic weaved material, etc.) which allows the straps 26 to be stretched so that the pallet wrap 20 can be used to wrap pallets of various sizes and dimensions without the need for straps of multiple different lengths. In another embodiment, the straps 26 may be of adjustable length by any suitable mechanism. In another embodiment, the straps 26 may be of fixed length and multiple sets of straps of various lengths may be provided for various pallet sizes.

Embodiments of pallet wraps may present an aesthetically pleasing view compared to a view of a pallet. Additionally, embodiments of pallet wraps may withstand contact and help to preserve pallets. Moreover, embodiments of pallet wraps may prevent contact with pallets by customers, allowing for covering up of, for example, splinters from wooden pallets, etc., preventing contact with protruding nails, etc.

Figure 3:
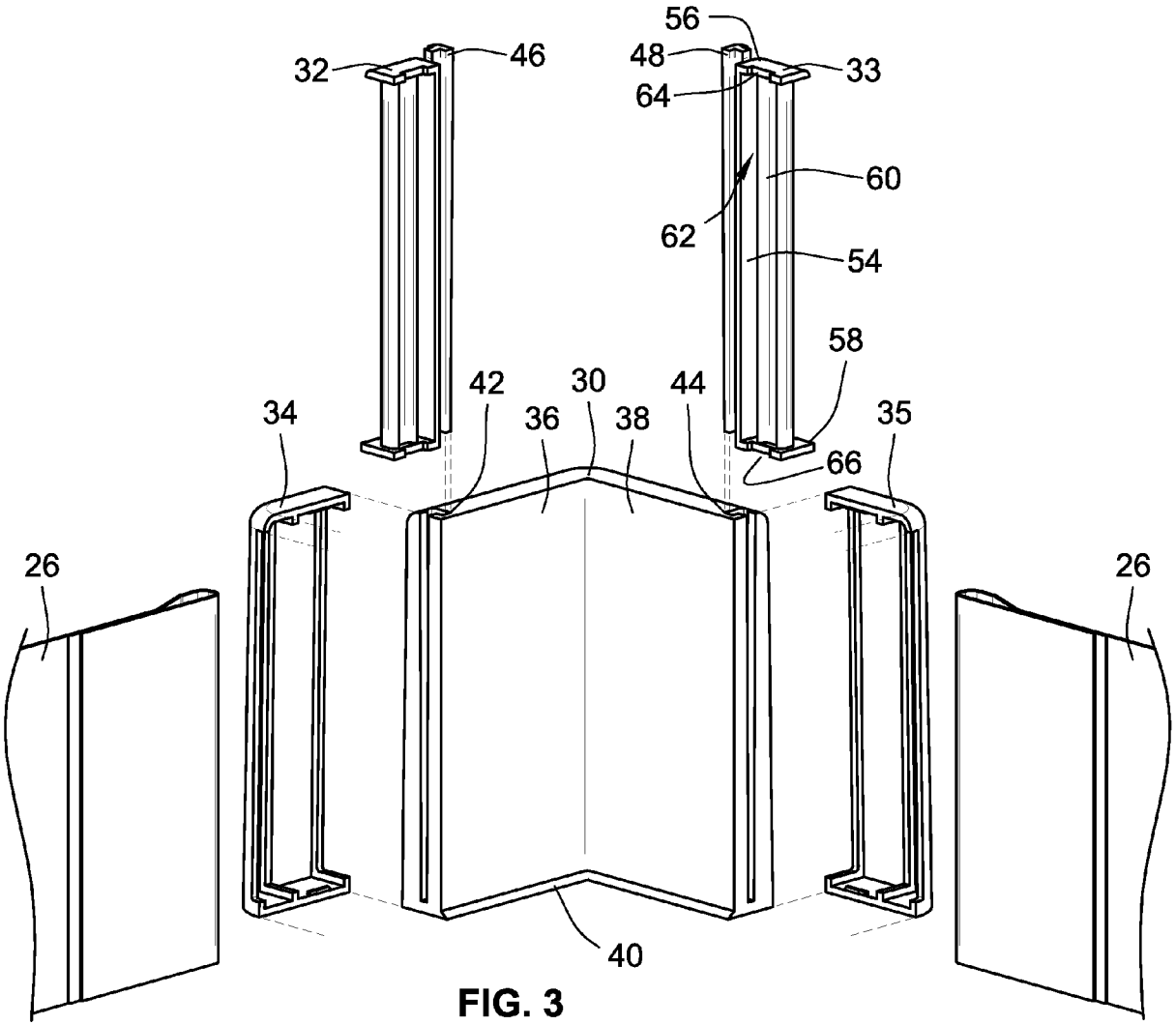
FIG. 3 is a detail view indicated at 3 in FIG. 2 of the exploded corner unit of FIG. 2.

With reference to FIG. 3, the corner unit 24 is described in greater detail. The corner unit 24 includes a central portion 30, a pair of strap connectors 32 and 33, and a pair of covers 34 and 35. The central portion 30 includes a first wall 36 and a second wall 38. The first and second walls 36 and 38 extend generally perpendicular from one another defining a corner. The first and second walls 36 and 38 define a lip 40 extending perpendicularly inwardly from the bottom peripheral edge of the first and second walls 36 and 38. The lip 40 is configured to engage the bottom of a pallet to prevent the pallet wrap 20 from inadvertent upward displacement relative to the pallet.

The corner unit 24 also includes a pair of connectors, illustrated in FIG. 3 as strap connectors 32 and 33. The strap connectors 32 and 33 are each configured to couple with the strap 26 as well as with the central portion 30. The strap connectors 32 and 33 each include a portion for connection with the central portion 30 and a portion for connection with a strap 26, as will be described below. The corner unit 24 also includes a pair of covers 34 and 35 configured to couple with and cover at least a portion of the strap connectors 32 and 33.

Figure 4:
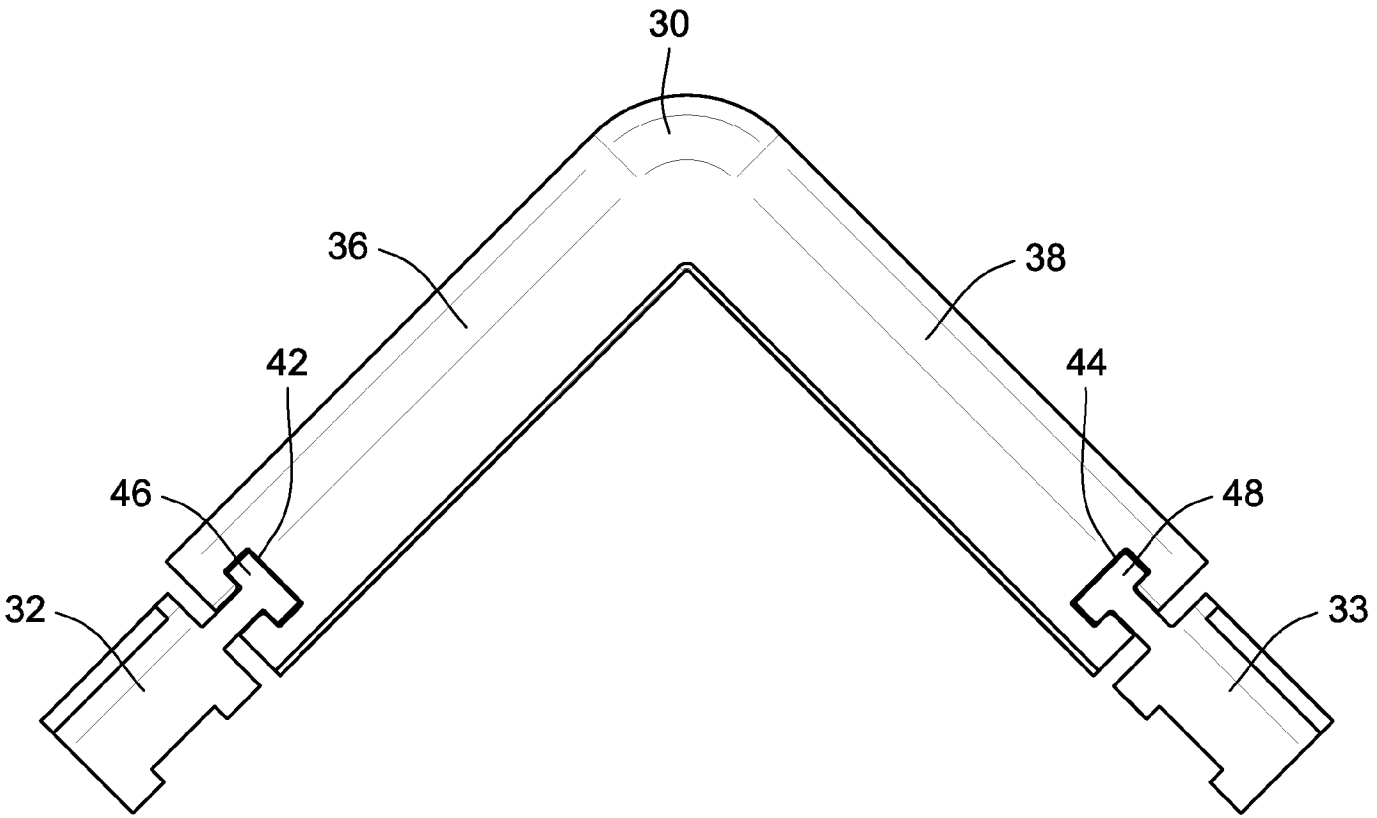
FIG. 4 is a top view of a corner unit engaged with strap connectors of the pallet wrap of FIG. 1.

With reference to FIGS. 3 and 4, the first wall 36 includes a connection portion illustrated in FIG. 3 as a slot 42, generally T-shaped when viewed from above as in FIG. 4, defined in a portion of the first wall 36 distal from the second wall 38. Similarly, the second wall 38 includes a connection portion illustrated in FIG. 3 as a slot 44, generally T-shaped when viewed from above as in FIG. 4, defined in a portion of the second wall 38 distal from the first wall 36. The strap connector 32 includes a connection portion, illustrated as a rail 46 in FIGS. 3 and 4, having a general T-shape when viewed from above as in FIG. 4, configured to be slidingly received by the T-shaped slot 42 of the first wall 36 of the central portion 30 coupling the strap connector 32 with the central portion 30. The strap connector 33 also includes a connection portion, illustrated as a rail 48 in FIGS. 3 and 4, having a general T-shape when viewed from above as in FIG. 4, configured to be slidingly received by the T-shaped slot 44 of the second wall 38 of the central portion 30 coupling the strap connector 33 with the central portion 30.

Figure 5:
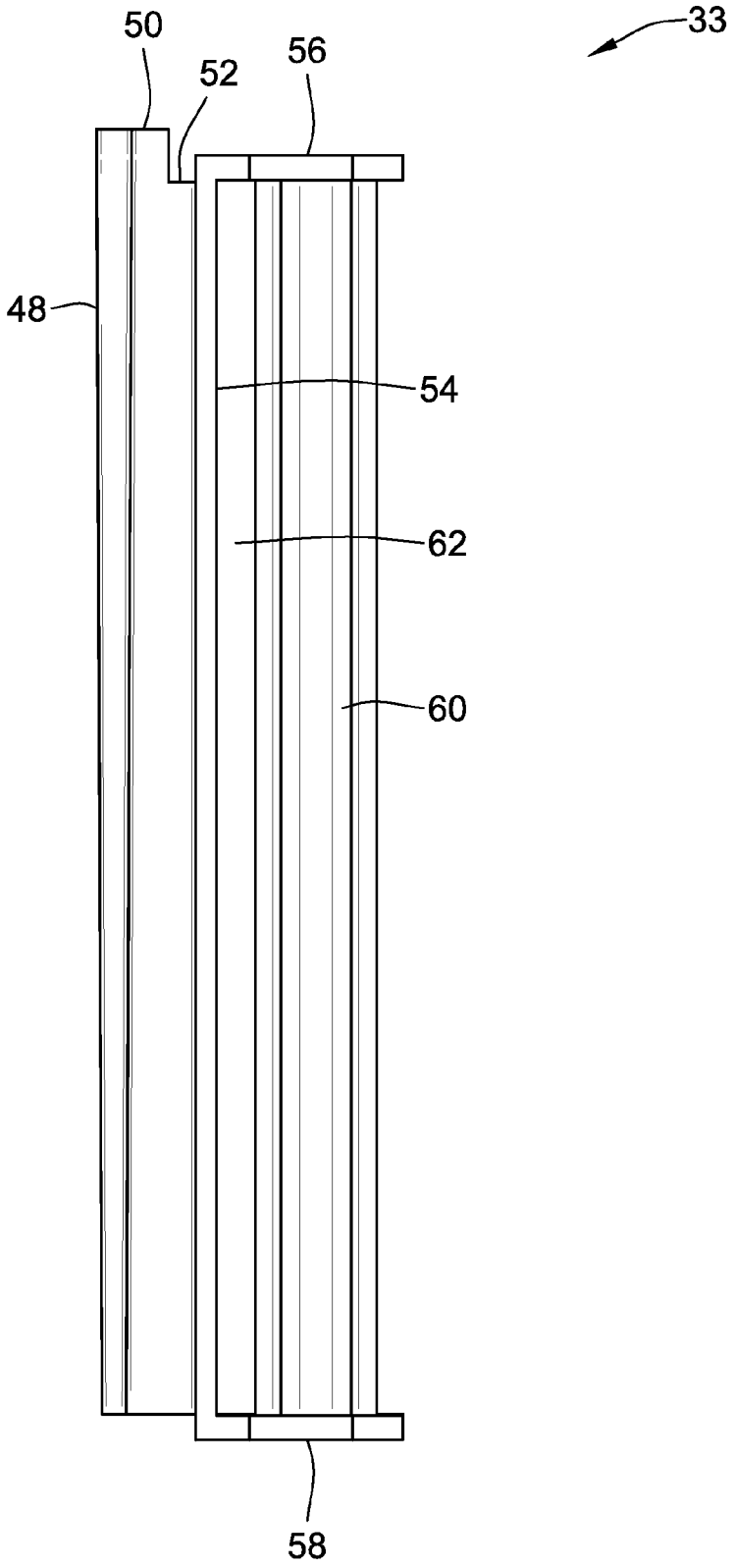
FIG. 5 is a side view of a strap connector of the pallet wrap of FIG. 1.

With reference to FIG. 5, the strap connector 33 is described in greater detail. Extending from the leg 50 of the T-shaped rail 48 is a connecting portion 52. The connecting portion 52 extends from the bottom of the T-shaped rail 48 to a portion of the T-shaped rail 48 below the top periphery of the T-shaped rail 48. The connecting portion 52 extends away from the T-shaped rail 48 and terminates at a generally vertical wall 54.

The generally vertical wall 54 is generally perpendicular to the connecting portion 52 and extends vertically lower than the bottom periphery of the connecting portion 52 and the bottom periphery of the T-shaped rail 48 and higher than the top periphery of the connecting portion 52 but lower than the top periphery of the T-shaped rail 48. Upper and lower flanges 56 and 58 extend from the top and bottom peripheries of the generally vertical wall 54 respectively. The upper and lower flanges 56 and 58 each extend generally perpendicularly to the generally vertical wall 54 and are generally parallel with one another.

Extending between the upper and lower flanges 56 and 58 is a post 60. The post 60 is spaced apart from the generally vertical wall 54 and with the generally vertical wall 54 defines an aperture 62 through which a strap 26 may pass allowing the strap 26 to be wrapped around the post 60 to couple the strap 26 with the strap connector 32.

The strap connector 32 is a mirror image of the strap connector 33, and for purposes of brevity, is not described in any greater detail than already described above.

Figure 6:
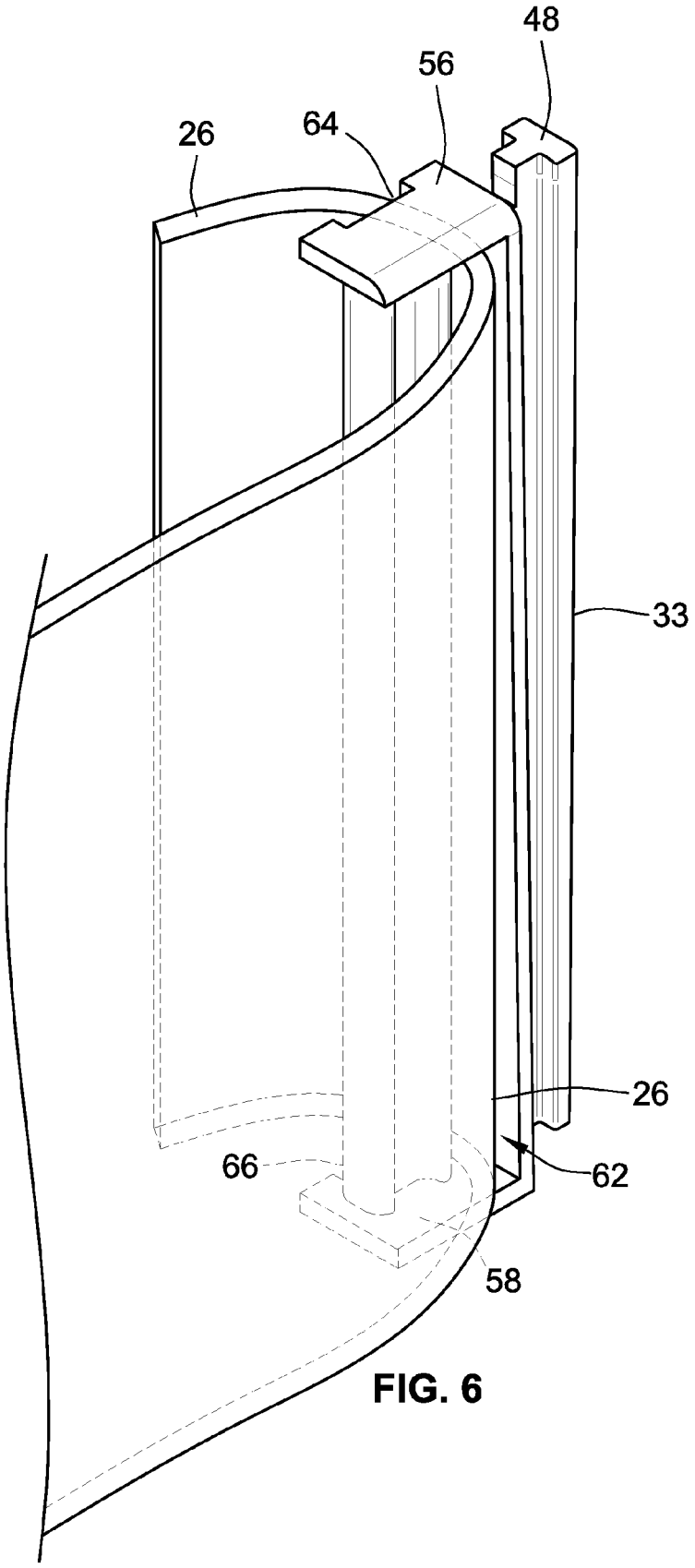
FIG. 6 is a perspective view of a strap inserted through an aperture of a strap connector of the pallet wrap of FIG. 1.

As illustrated in FIG. 6, a strap 26 may be threaded through the aperture 62. The strap 26 includes a retaining feature, such as, for example, hook and loop style fasteners, which allow the strap 26 to be wrapped around the post 60 and secured to itself, as illustrated in FIG. 7, securing the strap 26 to the corner unit 24.

Figure 7:
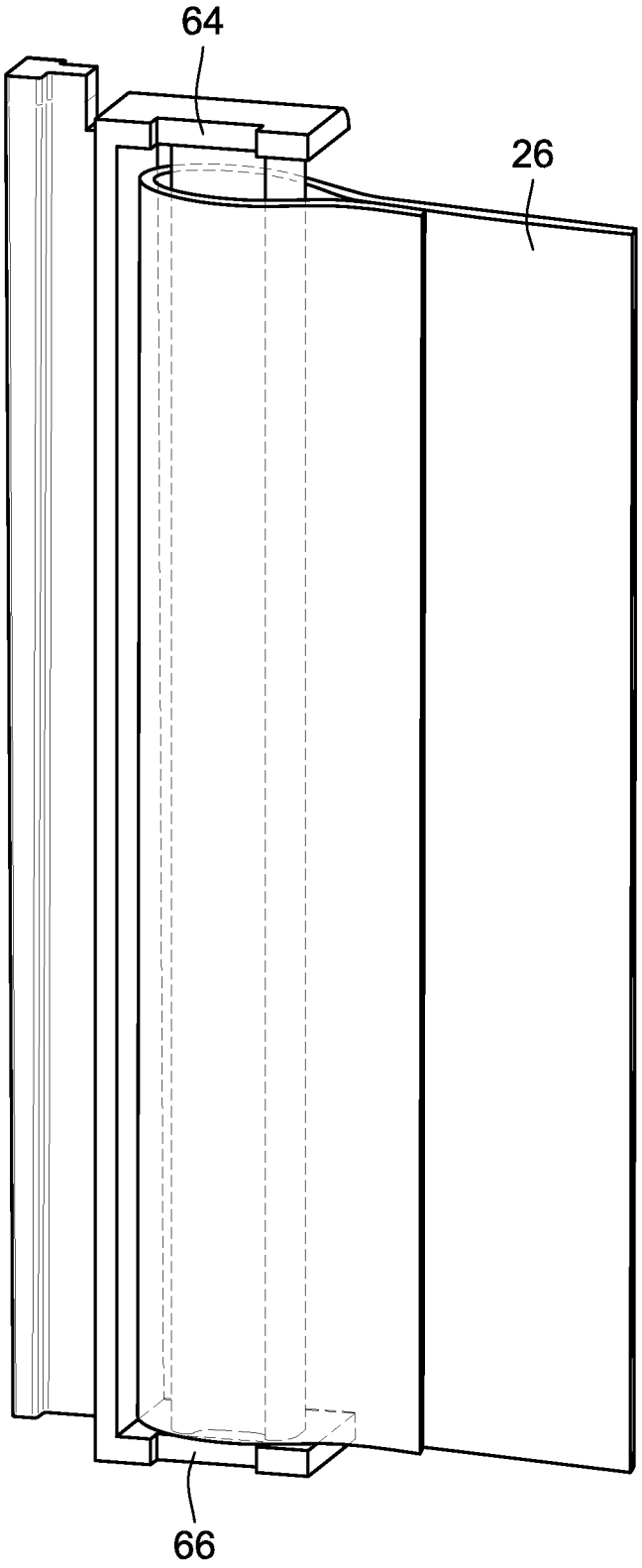
FIG. 7 is a perspective view of a strap inserted through an aperture of a strap connector of the pallet wrap of FIG. 1 taken from an opposite side as FIG. 6.

With further reference to FIGS. 6 and 7, the upper and lower flanges 56 and 58 each include a portion for coupling with the cover 35, illustrated in FIGS. 6 and 7 as a portion of the upper and lower flanges 56 and 58 defining detent slots 64 and 66 respectively. The interface between the flanges 56 and 58 and the cover 35 will be described further below.

Figure 8:
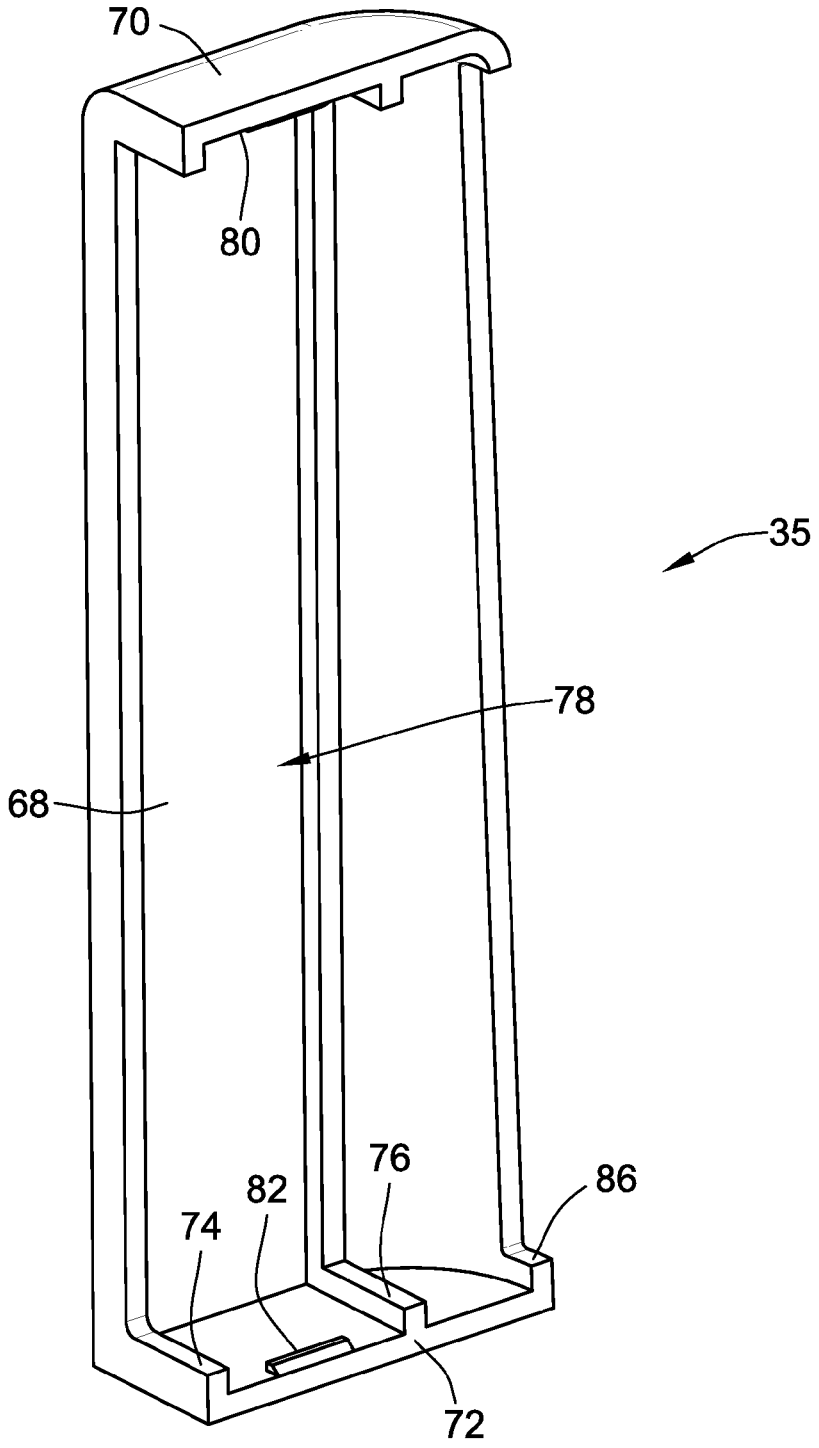
FIG. 8 is a perspective view of a cover of the pallet wrap of FIG. 1.

With reference to FIG. 8, the cover 35 (cover 34 is a mirror image of the cover 35) includes an outer wall 68 extending generally vertically between upper and lower inwardly extending flanges 70 and 72. The wall 68 and flanges 70 and 72 include a pair of generally parallel ribs 74 and 76 defining a recess 78 into which the strap connector 33 is received. The flanges 70 and 72 also each include an element for coupling the cover 35 with the strap connector 33, illustrated in FIG. 8 as a projecting tang 80 and 82. The outer wall 68 also includes a curved portion 84 extending from the rib 76 to a cutout portion 86. The cutout portion 86 is configured to receive a strap 26 extending from the strap connector 33.

Figure 9:
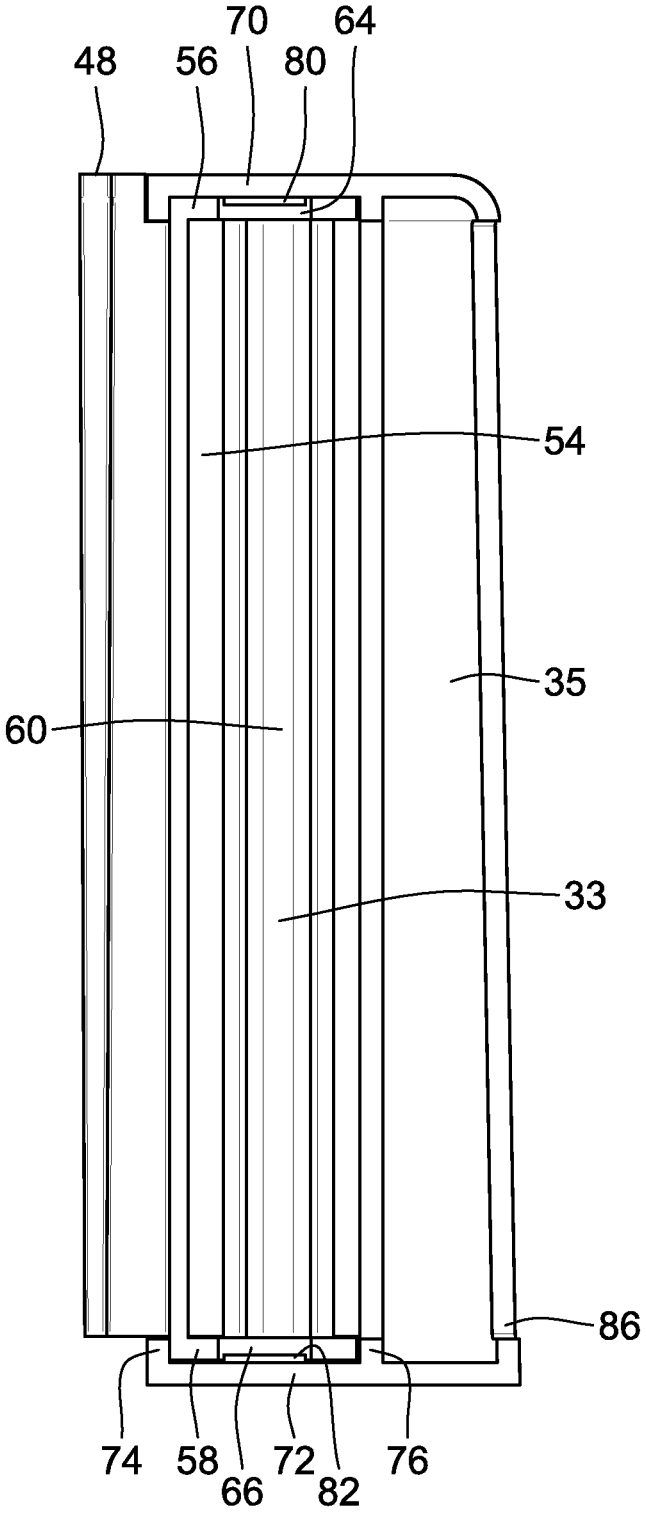
FIG. 9 is a view of the cover engaged with a strap connector of the pallet wrap of FIG. 1.

With reference to FIG. 9, the cover 35 is illustrated engaged with the strap connector 33. The upper and lower flanges 56 and 58, the post 60, and the generally vertical wall 54 of the strap connector 33 are disposed in the recess 78 formed by the ribs 74 and 76 of the cover 35. The upper flange 56 of the strap connector 33 abuts the upper flange 70 of the cover 35. The generally vertical wall 54 abuts the rib 76. The lower flange 58 of the strap connector 33 abuts the lower flange 72 of the cover.

These portions of the strap connector 33 are retained in the recess 78, and thus the strap connector 33 is coupled with the cover 35, by the tangs 80 and 82 disposed in the detent slots 64 and 66 respectively of the strap connector 33.

In one embodiment, the central portions 30, strap connectors 32 and 33, and covers 34 and 35 are each separately integrally molded plastic components. In other embodiments the corner units 24 may instead be formed as a single unitary piece or may be formed by any other suitable method or from any other suitable material. In other embodiments, the covers 34 and 35 may be omitted.

Figure 10:
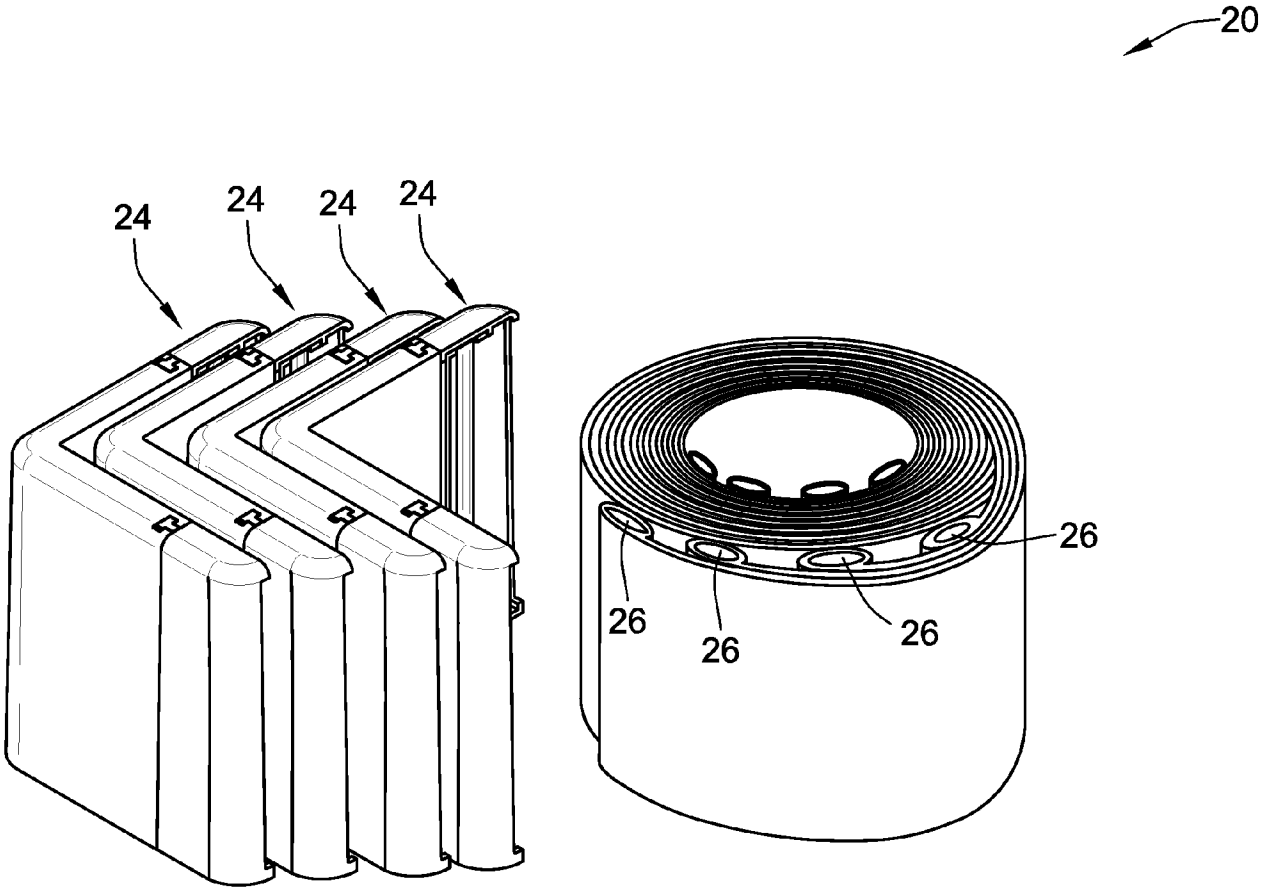
FIG. 10 is a perspective view of the pallet wrap of FIG. 1 in a non-wrapping configuration.

With reference to FIG. 10, in one embodiment the pallet wrap 20 is configured to be in a non-wrapping configuration when not in use, as illustrated. The corner units 24 may be nested with one another in a configuration that may provide space-saving. Also, the straps 26 may be rolled together. With the pallet wrap 20 in such a disassembled configuration, the pallet wrap 20 may be shipped while taking up a minimum of space, while being easily reassembled and reconfigured to wrap a pallet.

Pallet wraps 20 are described in the above embodiments as wrapping pallets, however, in other embodiments the pallet wraps may wrap pallets, skids, or any other support upon which merchandise is supported and displayed.

Additionally, while the corner units 24 and the straps 26 are illustrated as extending farther than the height of the pallet 22, this is exemplary, and in other embodiments other relative heights of corner units, straps, and pallets are used.

Figure 11:
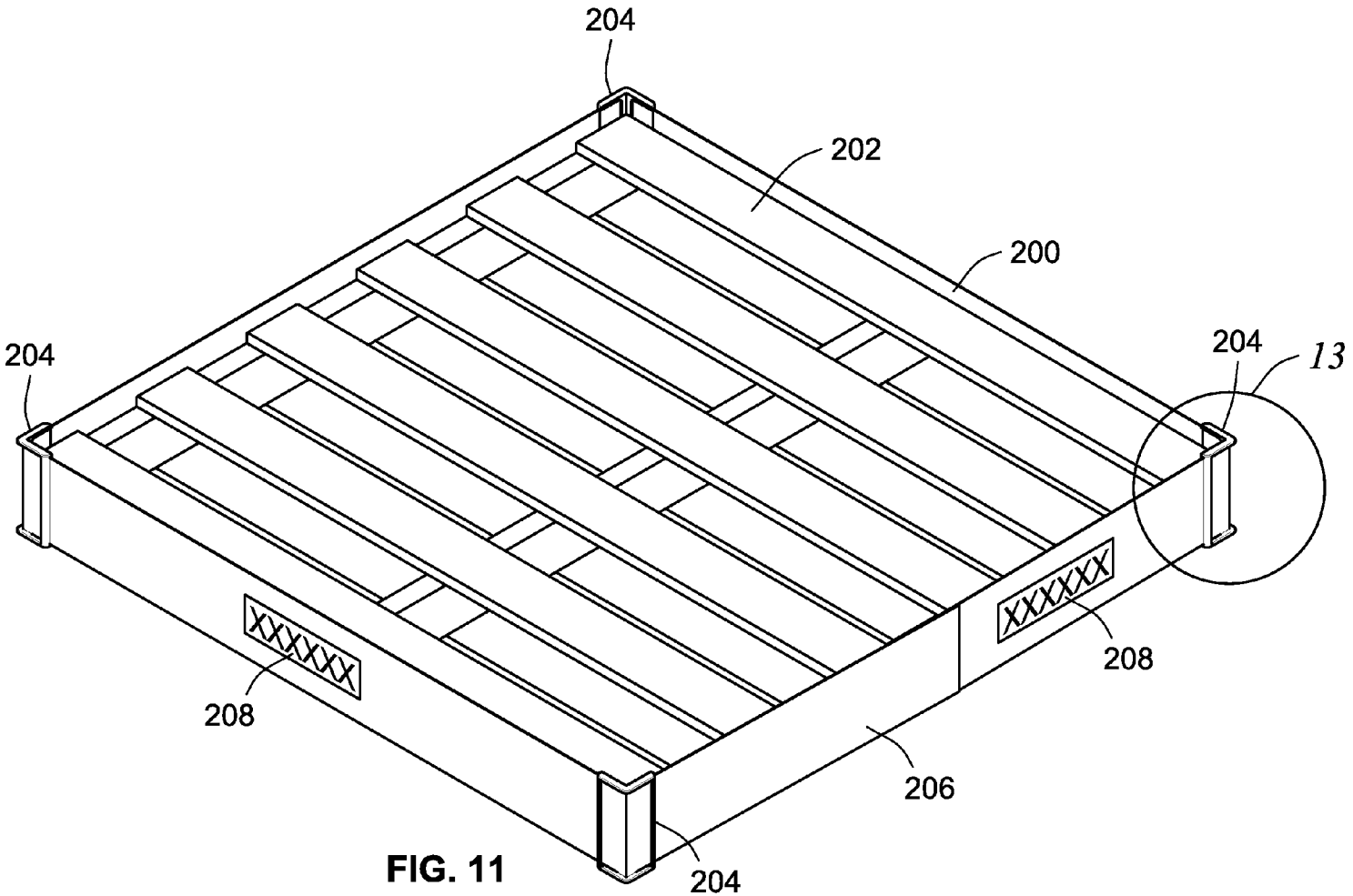
FIG. 11 is a perspective view of a second embodiment of a pallet wrap engaged with a pallet.
Figure 12:
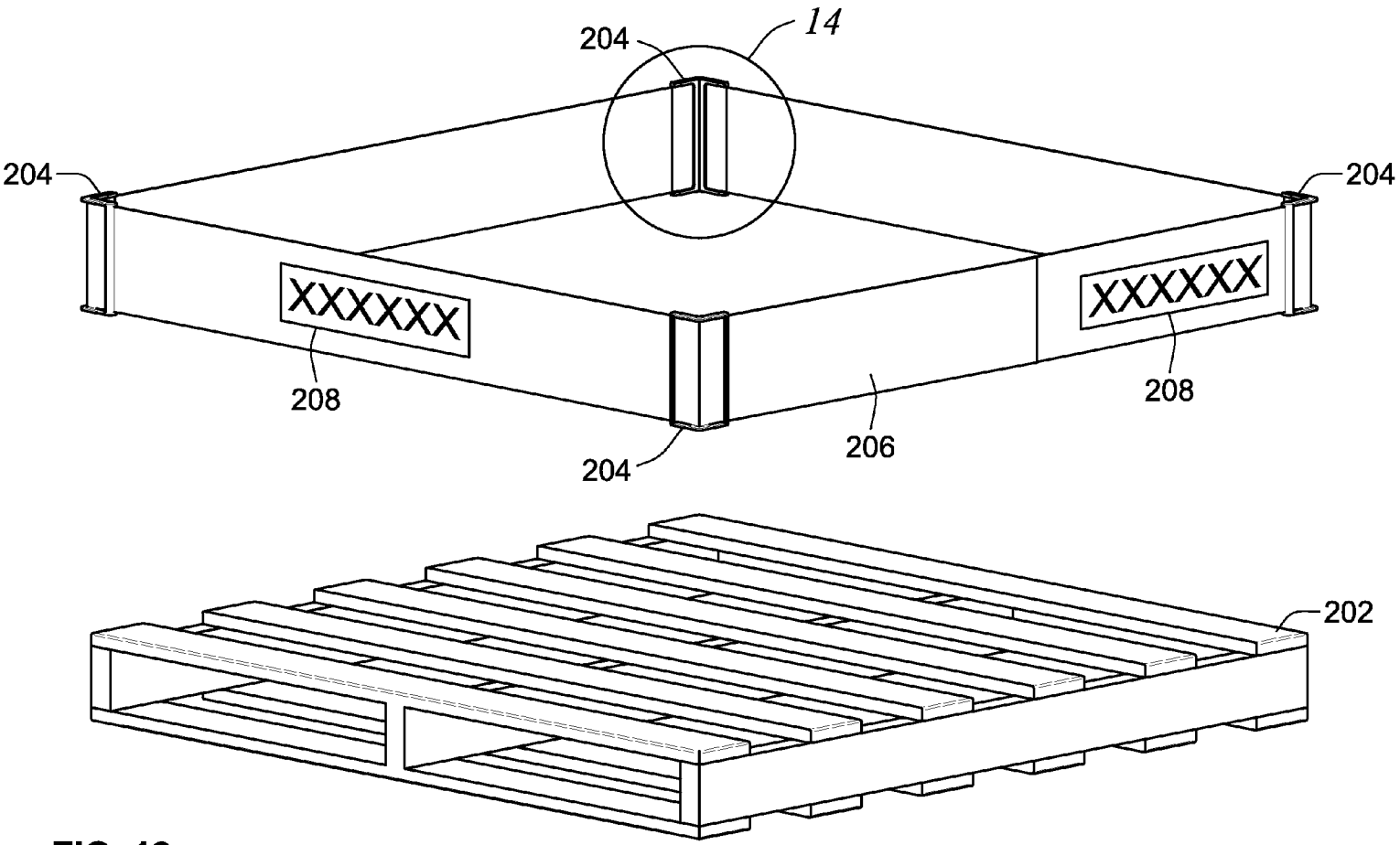
FIG. 12 is a perspective view the pallet wrap of FIG. 11 exploded from the pallet.

FIG. 11 illustrates a second embodiment of a pallet wrap 200. The pallet wrap 200 is illustrated wrapped around a pallet 202. FIG. 12 illustrates the pallet wrap 200 exploded from the pallet 202. The pallet wrap 200 includes four corner units 204 each configured to interface with one of the four corners of the pallet 202 and a strap 206 extending around and generally covering the perimeter of the pallet 202. The strap 206 interfaces with the corner units 204 and is coupled to itself to form a generally continuous surrounding of the perimeter of the pallet 202. In one embodiment, the strap 206 is coupled to itself using a coupling mechanism, such as, for example, hook and loop style fasteners. In other embodiments, any suitable type of coupling mechanism or fastener may be used.

In one embodiment, the strap also includes indicia 208 printed at various intervals along the strap 206. The indicia 208 may include advertisements, information regarding product on the pallet, manufacturer information, pricing, or any other information, printed thereon. Additionally, the indicia 208 may instead be attached to the strap 206 by any suitable mechanism. The spacing of the indicia 208 may be selected to place the indicia 208 at various locations relative to the pallet 202 when the pallet wrap 200 is applied to the pallet 202.

FIG. 12 illustrates an embodiment of a pallet wrap 200 exploded away from a pallet 202.

Figure 13:
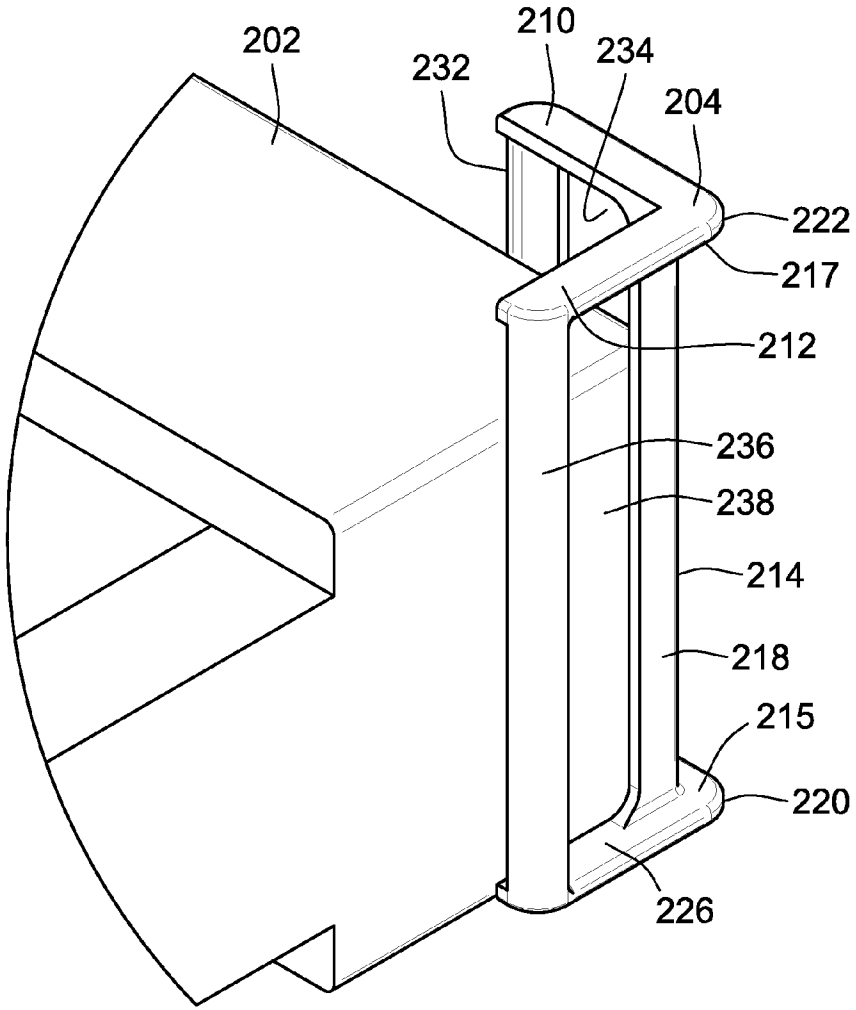
FIG. 13 is a detail view of the portion indicated at 13 in FIG. 11.

With reference to FIG. 13, a corner unit 204 is illustrated engaged with a corner of a pallet 202. In one embodiment, the four corner units 204 are generally identical. Therefore, one corner unit 204 is described. In other embodiments, the corner units 204 may each have different characteristics.

Figure 14:
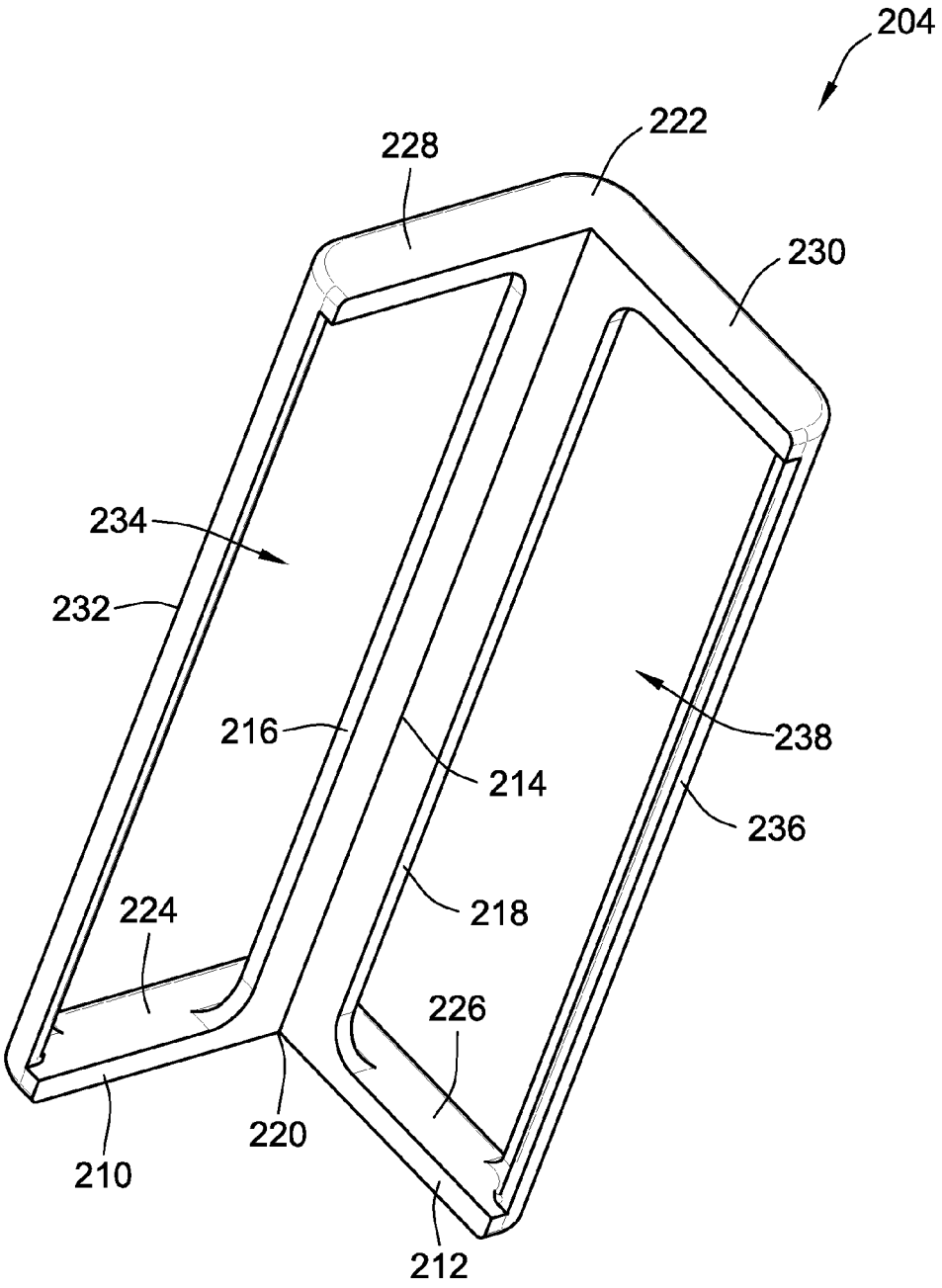
FIG. 14 is a perspective view of a corner unit of the pallet wrap of FIG. 11.

With reference to FIGS. 13 and 14, the corner unit 204 generally includes a left half 210 and a right half 212 extending generally perpendicularly to one another and forming between them a corner into which a corner of a pallet 202 may be received.

The corner unit 204 includes a central beam 214 including a left half 216 and a right half 218, the left and right halves 216 and 218 extending generally perpendicularly to one another and forming a corner therebetween. The central beam 214 extends between a lower generally corner-shaped flange 220 and an upper generally corner-shaped flange 222 proximate the interior (pallet-abutting) side of the flanges 220 and 222. The flanges 220 and 222 each include a generally flat portion 215 and 217 against which the upper and lower peripheral ends of the strap 206 may abut.

The lower generally corner-shaped flange 220 includes a left portion 224 and a right portion 226 extending generally perpendicular from one another and forming a corner therebetween. The upper generally corner-shaped flange 222 includes a left portion 228 and a right portion 230 extending generally perpendicular from one another and forming a corner therebetween.

Extending between the left portion 224 of the lower generally corner-shaped flange 220 and the left portion 228 of the upper generally corner-shaped flange 222 distal from the central beam 214 is a left beam 232. The left beam 232, together with the central beam 214, the left portion 224 of the lower generally corner-shaped flange 220 and the left portion 228 of the upper generally corner-shaped flange 228 together define a generally rectangular left aperture 234. The left aperture 234 is configured to receive the strap 206 therethrough, as will be further described below.

Extending between the right portion 226 of the lower generally corner-shaped flange 220 and the right portion 230 of the upper generally corner-shaped flange 222 distal from the central beam 214 is a right beam 236. The right beam 236, together with the central beam 214, the right portion 226 of the lower generally corner-shaped flange 220 and the right portion 230 of the upper generally corner-shaped flange 222 together define a generally rectangular right aperture 238. The right aperture 238 is configured to receive the strap 206 therethrough.

Figure 15:
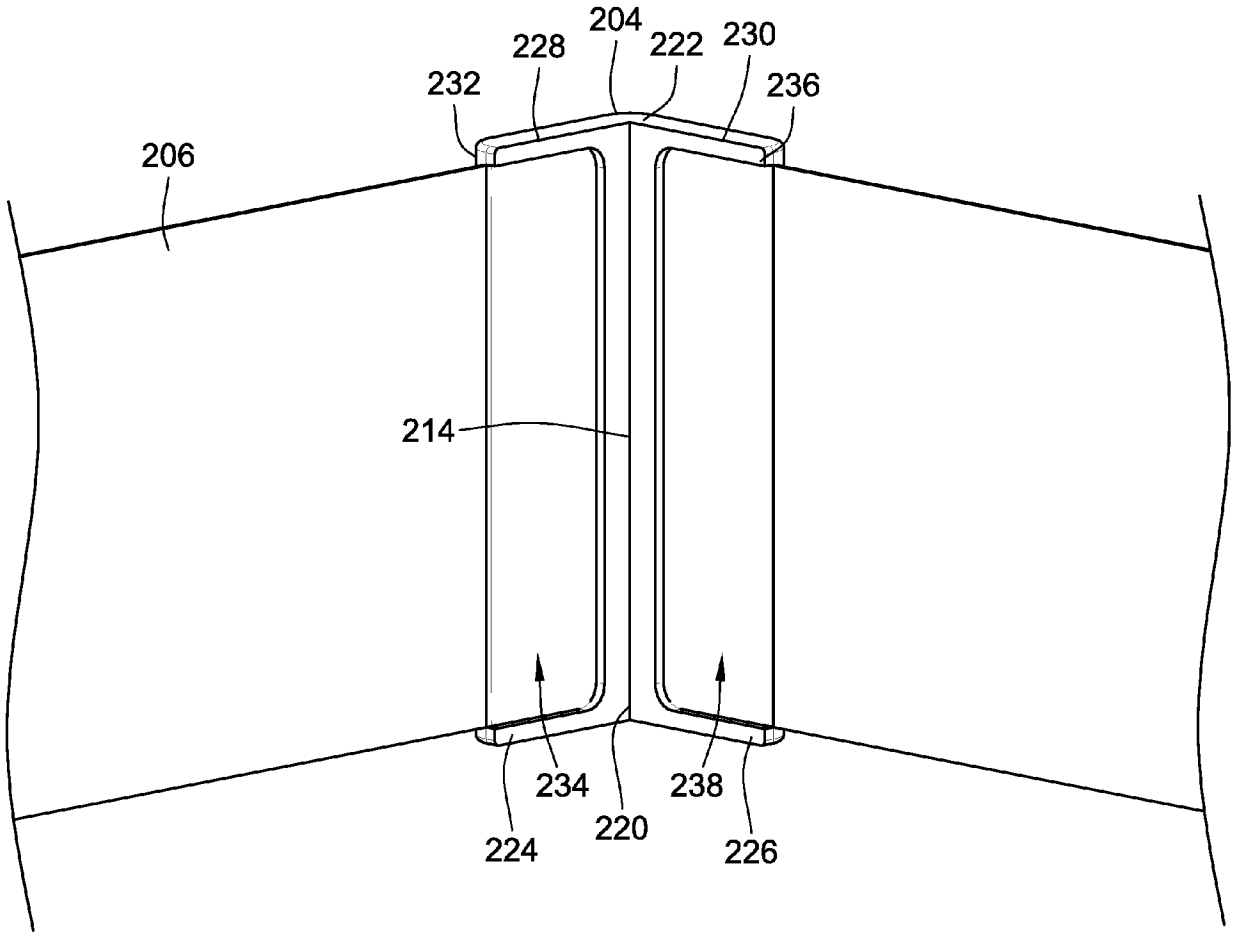
FIG. 15 is a view of a corner unit and a strap of the pallet wrap of FIG. 11 interfaced.

With reference to FIG. 15, in one embodiment the strap 206 is configured to pass past the interior (pallet side) surface of the right beam 236, through the right aperture 238, behind (non-pallet side) of the central beam 214, through the left aperture 234, and past the interior (pallet side) surface of the left beam 232.

With strap 206 threaded through each of the four corner units 204 as described above, the strap 206 is coupled to itself, such as by a fastener, such as by hook and loop style fasteners, or any other suitable type of fasteners, surrounding the perimeter of a pallet.

In one embodiment, the strap 206 is formed from elastic material (e.g., elastic weaved material, etc.) which allows the strap 206 to be stretched so that the pallet wrap 200 can be used to wrap pallets of various sizes and dimensions without the need for straps of multiple different lengths. In another embodiment, the strap 206 may be of adjustable length by any suitable mechanism. In another embodiment, the strap 206 may be of fixed length and multiple different straps of various lengths may be provided for various pallet sizes.

In one embodiment, the corner units 204 are unitarily formed from plastic, metal, or any other suitable material. In other embodiments, the corner units 204 are formed from any suitable material.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A display wrap comprising:

first and second corner units each configured to couple with respective corners of a retail display, the retail display having a perimeter surface;

a strap configured to extend from the first corner unit to the second corner unit generally covering at least a portion of the perimeter surface;

wherein the first and second corner units are configured to interface with the strap to position the strap relative to the retail display when the first and second corner units are coupled with corners of the retail display;

wherein each corner unit includes a central portion including a first wall and a second wall angularly extending from the first wall;

wherein the first walls each define a first slot configured to receive a first strap connector;

wherein the second walls each define a second slot configured to receive a second strap connector;

wherein the display wrap, further comprises four first strap connectors each including a first rail configured to be selectively received within a first slot of one of the first walls to couple a first strap connector to a first wall;

four second strap connectors each including a second rail configured to be selectively received within a second slots of one of the second walls to couple a second strap connector to a second wall;

wherein the first strap connectors each define a first aperture through which one of the straps can be threadingly inserted and a first post around which the one of the straps can be folded back on itself and coupled with itself to selectively couple the one of the straps to the one of the first strap connectors; and wherein the second strap connectors each define a second aperture through which another one of the straps can be threadingly inserted and a second post around which the another one of the straps can be folded back on itself and coupled with itself to selectively couple the another one of the straps to the one of the second strap connectors.

2. The display wrap of claim 1, further comprising third and fourth corner units each configured to couple with a corner of a retail display;

wherein the strap is a first strap; and wherein the display wrap further comprises second, third, and fourth straps.

3. The display wrap of claim 1, wherein each central portion includes a lip extending from the first wall and the second wall, the lip configured to contact a bottom surface of a retail display.

4. The display wrap of claim 1, wherein each of the four first strap connectors includes a pair of detent slots; and wherein each of the four second strap connectors includes a pair of detent slots.

5. A display wrap comprising:

first and second corner units each configured to couple with respective corners of a retail display, the retail display having a perimeter surface;

a strap configured to extend from the first corner unit to the second corner unit generally covering at least a portion of the perimeter surface;

wherein the first and second corner units are configured to interface with the strap to position the strap relative to the retail display when the first and second corner units are coupled with corners of the retail display;

wherein each corner unit includes a central portion including a first wall and a second wall angularly extending from the first wall;

wherein the first walls each define a first slot configured to receive a first strap connector; and wherein the second walls each define a second slot configured to receive a second strap connector;

wherein the display wrap further comprises four first strap connectors each including a first rail configured to be selectively received within a first slot of one of the first walls to couple a first strap connector to a first wall;

four second strap connectors each including a second rail configured to be selectively received within a second slots of one of the second walls to couple a second strap connector to a second wall;

wherein each of the four first strap connectors includes a pair of detent slots;

wherein each of the four second strap connectors includes a pair of detent slots;

further comprising four first covers, each first cover including a pair of tangs configured to be received in the detent slots of one of the first strap connectors to couple the one of the first covers with the one of the first strap connectors; and further comprising four second covers, each second cover including a pair of tangs configured to be received in the detent slots of one of the second strap connectors to couple the one of the second covers with the one of the second strap connectors.

6. The display wrap of claim 1, wherein the strap includes indicia printed thereon.

* * * * *